US006723207B2

(12) United States Patent
Laser

(10) Patent No.: US 6,723,207 B2
(45) Date of Patent: Apr. 20, 2004

(54) METHOD OF TREATING PAPER MAKING ROLLS

(75) Inventor: Harold Laser, Hamilton (CA)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 10/212,595

(22) Filed: Aug. 5, 2002

(65) Prior Publication Data

US 2004/0020617 A1 Feb. 5, 2004

(51) Int. Cl.[7] ..... D21H 21/02

(52) U.S. Cl. ..... 162/199; 162/164.6; 162/168.2; 162/179; 162/DIG. 4

(58) Field of Search ..... 162/5, 70, 72, 162/75, 77, 198, 199, 263, 272, 158, 164.1, 164.6, 168.1, 168.2, 168.3, 173, 183, DIG. 4, 10, 179; 210/705, 723, 729–736; 106/2, 14.41; 524/1

(56) References Cited

U.S. PATENT DOCUMENTS

| | | | | | |
|---|---|---|---|---|---|
| 4,184,912 | A | * | 1/1980 | Payton | 162/72 |
| 4,370,464 | A | | 1/1983 | Tanaka et al. | |
| 4,995,944 | A | * | 2/1991 | Aston et al. | 162/199 |
| 5,130,358 | A | | 7/1992 | Danner | |
| 5,292,403 | A | | 3/1994 | Dresbach et al. | |
| 5,368,694 | A | * | 11/1994 | Rohlf et al. | 162/199 |
| 5,389,207 | A | | 2/1995 | Rodriguez et al. | |
| 5,474,655 | A | | 12/1995 | Schulte et al. | |
| 5,556,510 | A | * | 9/1996 | Dreisbach et al. | 162/158 |
| 6,171,445 | B1 | * | 1/2001 | Hendriks et al. | 162/199 |
| 6,303,002 | B1 | * | 10/2001 | Linhart et al. | 162/199 |
| 6,368,466 | B1 | | 4/2002 | Laapotti | |

FOREIGN PATENT DOCUMENTS

| | | | | |
|---|---|---|---|---|
| EP | 0 599 440 A1 | * | 6/1994 | D21H/21/02 |
| GB | 2115829 | * | 9/1983 | C08F/20/60 |

OTHER PUBLICATIONS

Duy T. Nguyen, *Prevention of pitch and stickles deposition on paper–forming wires via adsorption of a cationic polymer associated with anionic species*, vol. 81, No. 6 TAPPI Journal Jun. 1998.

* cited by examiner

*Primary Examiner*—Steven P. Griffin
*Assistant Examiner*—Eric Hug
(74) *Attorney, Agent, or Firm*—Wood, Herron & Evans, L.L.P.

(57) ABSTRACT

A method of reducing the surface tension on papermaking rolls comprises applying to the papermaking roll an effective amount of a blend of catonic water soluble polymer, nonionic surfactant and anionic surfactant. The composition has an overall positive charge. Preferably the cationic polymer is a quatemary ammonium compound.

10 Claims, No Drawings

METHOD OF TREATING PAPER MAKING ROLLS

FIELD OF THE INVENTION

Paper is formed from a variety of different materials and to a variety of different specifications. For example, card stock is manufactured from fibers derived from the Kraft paper process, among others. These fibers are formed from wood, chemically broken down into fibers. They generally contain a large amount of pitch. The card stock itself is relatively thick and produced at slower speeds.

Newsprint is formed from varying amounts of recycled paper and mechanically separated wood derived fibers. Therefore the fiber characteristics are significantly different. Newsprint is thinner than card stock and produced at a much faster speed.

During the manufacture of paper, a web of paper fibers derived from wood sources and also from recycled paper sources is typically formed on the surface of a fabric mesh which is used to drain excess water from the web. The drained web of paper fibers is then introduced into a series of rolls, some of which are covered by continuous belts of fabric or felt. As the paper web is fed through the rolls and between the layers of felt, pressure is applied to the paper web which forces water from the web.

The paper web contacts the surface of some rolls directly. Pressure is applied in these instances to make the paper smooth. The surface of the roll may be rubber, steel, chrome steel, ceramic, minerals such as granite and various composite materials. Surface tension causes the paper web to adhere to the surface of the papermaking roll.

Because of the thinness of the formed paper as well as the speed at which the rollers operate, surface tension between the papermaking roll and the paper web presents a significant concern with newsprint and other thinner papers. Higher surface tensions will tend to force one to operate at slower speeds and can cause more frequent web breaks. This combines to decrease the speed at which the paper is produced and thereby increasing its overall expense. Also the deposition of various organic materials, both synthetic and naturally derived onto the surface of a papermaking roll causes excessive adhesion of the papermaking web to the roll surface. This deposition is a major factor in the development of poor sheet release especially in grades of papers using pulp from recycled sources or using pulp from resin containing woods.

SUMMARY OF THE INVENTION

The present invention is premised on the realization that surface tension between a papermaking roll and a paper web can be significantly reduced by continuously coating the surface of the papermaking roll with a liquid mixture including a cationic polymer, a non-ionic surfactant and an anionic surfactant. The amount of the anionic surfactant relative to the cationic polymer is such that the cationic polymer retains a substantial portion of its positive charge, generally 10%–50%.

More preferably the cationic polymer is a polydiallyidimethyl ammonium chloride and the anionic surfactant is a carboxylated linear alcohol, although a wide variety of other polymers and surfactants can be employed.

This is particularly effective at reducing surface tension at high speed mills producing thinner finer paper products which generally operate at 2800 to 4100 ft./min.

The invention will be further appreciated in light of the following detailed description.

DETAILED DESCRIPTION

The present invention is a method of reducing surface tension between papermaking rolls and the web as it is being compressed and keeping the surface of a papermaking roll free of deleterious deposits. This is accomplished by applying the composition of the present invention directly to the papermaking rolls. The composition of the present invention comprises a cationic polymer in combination with a non-ionic surfactant and an anionic surfactant.

A wide of variety of cationic polymers can be used in the present invention. In general, these cationic polymers must be water soluble and are formed from cationic monomer units or both cationic and non-ionic monomer units. By the term catonic is meant that the monomer unit includes a group which either carries a positive charge or which has basic properties and can be protonated under mild acidic conditions.

Suitable polymers include cationic addition and condensation polymers. The polymer will generally be composed partially of vinyl addition polymers of cationic and optionally non-ionic vinyl monomers.

One preferred class is the quatemary ammonia compounds. These quatemary ammonia polymers are generally derived from ethylenically unsaturated monomers containing a quaternary ammonium group or obtained by reaction between an epihalohydrin and one or more amines such as those obtained by reaction between a polyalkylene polyamine and epichlorohydrin or by reaction between epichlorohydrin, dimethyl amine and either ethylenediamine or polyalkylene polyamine.

Cationic polymers are disclosed in U.S. Pat. No. 5,368,694 the disclosure of which is incorporated herein by reference. Generally with all these the molecular weight must be such that the polymer is water soluble or dispersible.

Other suitable cationic polymers include cationized polyacrylamides including polyacrylamides cationized with dimethylsulfate or methyl chloride by the Mannich reactions to varying degrees to achieve varying degrees of cationicity, polymers derived from quatemized dimethyl aminoethylacrylate, dicyanamide-formaldehyde condensates using one or both of formic acid and ammonium chloride as reactants, cationic cellulose starch compounds, carboxylated starch, xanthan gum, guar gum and polyacrylic acid. One preferred cationic polymer is polydiallyidimethylammonium chloride.

A wide variety of non-ionic surfactants can be used in the present invention. These include ethoxylated fatty alcohols which are either linear or branched and which may have a carbon chain length of anywhere from 8 to 22 carbons. The degree of ethoxylation may vary from 2 moles to 30 moles of ethylene oxide per mole of alcohol. Ethoxylated adducts of octyl phenols as well as ethoxylated polyhydric alcohols including sorbitols or sorbitan esters may be used. Additional non-ionic surfactants include polyethylene oxide/polypropylene oxide block copolymers which would include the Pluronic® line of surfactants as well as ethoxylated versions of fatty acids and polyethylene glycol esters of phosphates, polyethylene glycol esters of fatty acids including esters derived from one mole of polyethylene glycol and one or two moles of fatty acids, tristyrylphenol ethoxylates and alkylpolyglycosides.

Generally the HLB of these surfactants will be from 7 to 18 with a preferred range being from about 11–13.

The third component of the present invention is an anionic surfactant. Suitable anionic surfactants include water soluble or water dispersible alkylarylsulfonates, sulfonated amines and amides, carboxylated alcohol ethoxylates, diphenylsulfonate derivatives, lignin and lignin derivatives, phosphate esters, soaps of process rosin, sulfates and sulfonates of ethoxylated alkyl phenols, sulfates of ethoxylated alcohol, sulfonates of napthalene and alkylnapthalene, polyethoxy carboxylic acid alcohols from the Neodox™ or Sandopan™ line of products, alky ether sulfates, alkyl benzene sulfonates (branched or linear), alkyl phosphates, alkyl sulfates, alpha olefin sulfonates, diphenyloxide disulfonates sulfosucinnates, ethoxylated sulfosucinnates and succinamates. The preferred surfactant of the present invention is a carboxylic acid capped ethoxylated tridecyl alcohol.

Preferably the composition comprises polydiallyldimethylamoniumchloride in combination with trideceth (7) carboxylic acid and linear alcohol ethoxylate such as Rexonic® N23-6.5 or Neodol® N23-6.5.

The amount of anionic surfactant to cationic polymer should be established so that the cationic polymer retains a significant portion of its cationic charge. Generally from 10%–80% of its positive charge should be maintained after the addition of the anionic surfactant.

With only the above three components, the composition will be very acidic. The pH of the composition can be raised by the addition of water soluble bases such as sodium or potassium hydroxide, sodium or potassium carbonate, ammonia, organic amines such as triethanolamine, diethanolamine, monoethanolamine, or morpholine as well as other compatible bases. Sufficient base can be added to establish a desired pH of from about 3 up to about 10 depending on preference for the particular papermaking operation.

The composition of the present invention will generally include 2% to 20% by weight cationic polymer, 2% to 40% by weight nonionic surfactant, 0.5% to 10% anionic surfactant 0% to 5% base with the remainder water.

One preferred formulation is as follows:

| | |
|---|---|
| Agefloc WT 40HB | 5% |
| Rexonic N23-6.5 | 7.4% |
| Sandopan DTC Acid | 1.1% |

with the remainder water.

Preferably the papermaking rolls will be cleaned prior to the initiation of the treatment. This formulation is sprayed directly onto the papermaking rolls as they are moving to maintain the surface of the roller moist with the release formulation. Generally the amount of the composition of the present invention applied to a roll will be about 0.1 to 5 ml/minute for each 10 inches of machine width. This treatment is continued as the papermaking process continues.

The present invention will be further appreciated in light of the following example.

EXAMPLE 1

Mill Type: Linerboard

Furnish: Recycled cardboard OCC and unbleached Kraft

Application Location: 1$^{st}$ Press Granite roll of Combi-Press

Problem: Drastic differences in furnish quality, combined with swings in shower water temperature resulted in deposition on the granite roll. Bands of deposition interfered with sheet release, resulting in numerous breaks. The only solution was to shut the paper machine down and wash the granite roll.

The above preferred formulation was applied to the press granite roll at the applicable rate of 26 ml/min. The deposition problems completely disappeared. There are no release problems from this granite, and no machine breaks due to poor granite roll condition. Program costs were dramatically reduced.

EXAMPLE 2

Mill Type: High Brite Ground-wood Specialty grades

Furnish: Groundwood, Semi-Chemi mechanical pulp, purchased kraft, Calcine clay

Application Location: Centre "Valroc" on Twinver type press

Problem: Condition of Valroc roll resulted in fibre being pulled from sheet. In severe cases this would result in wet end pick-out breaks. Fugitive fibre could be seen to be doctored off Valroc.

The above preferred formulation was applied directly to the Valroc roll at a rate of 26–30 ml/min. The center press pick-out breaks were virtually eliminated. There was also a significant reduction in draw between the second and third presses (as a percentage of reel speed, the draw was reduced from 2.05% to 1.80%). As well, the mill was able to increase its average doctor blade life from 1.5 days to 3 days. Machine runnability and production increased during this treatment period.

EXAMPLE 3

Mill Type: High Speed Recycled/TMP Newsprint

Furnish: Recycled Newsprint, Thermal Mechanical Pulp, Ground-wood, bleached Kraft Application Location: Center Voith "Ceralease"

Problem: Incumbent roll release barrier treatment program was effective much of the time, but during periods of furnish upset, deposition developed on center roll resulting in degraded, uneven sheet release, "pick-out" breaks at the center roll and prematurely worn doctor blades.

The above preferred formulation was applied directly to the center roll at a rate of 30 ml/min. Breaks at the center roll position became very infrequent. In addition to this, the draw from the 3$^{rd}$ to 4$^{th}$ press section was reduced significantly (as a percentage of the forming wire speed, the draw was reduced from 2.00% to 1.85%). This reduction in draw increased the machine direction stretch of the sheet, as indicated from testing done on the mill's automated paper testing equipment. Also, the doctor blade life at this location was increased from 4 days to 10 days. Further, the roll release program costs were significantly reduced.

As shown in the preceding examples, the present invention is particularly effective at improving the release of paper from a roll surface. This in turn reduces down time, allows faster operation and provides an improved product. With respect to the formation of thicker cardboard stock and the like, the present invention also reduced pitch and sticky formation on the press rolls reducing system downtime require for cleaning of the rolls. Thus, the present invention has application both in the high speed and lower speed operations for a variety of paper grades and furnishes. Thicker board stock paper in the range of 150–250 grams/m$^2$ run on slower machines. This paper is often partially made with recycled cardboard. It is important to keep the surface of a roll clean to avoid the accumulation of sticky materials on the surface of the roll. Because this paper is thicker and the roll speed is slower, surface tension is not an issue. Lighter papers, including newsprint may only weigh 40–55 grams/m$^2$. As this thinner paper is produced at higher speeds, 2800 ft/min or greater, surface tension becomes more of a problem than avoiding sticky formation on the rolls. The composition of the present invention surprisingly addresses both issues.

This has been a description of the present invention along with the preferred method of practicing the present invention. However, the invention itself should be defined by the appended claims wherein we claim:

What is claimed is:

1. A method of treating a papermaking roll comprising applying a cationic composition onto said roll said cationic composition comprising a cationic water soluble polymer, a non-ionic surfactant and an anionic surfactant wherein said composition has a ratio of cationic polymer to anionic surfactant effective to establish a positive charge for said composition.

2. The method claimed in claim 1 wherein said composition comprises 2% to 20% cationic polymer and 0.5% to 10% by weight of anionic surfactant.

3. The method claimed in claim 2 wherein said composition includes 2% to 40% by weight nonionic surfactant.

4. The method claimed in claim 3 wherein said cationic polymer is poly-diallyidimethylammonium chloride.

5. The method claimed in claim 1 wherein said nonionic surfactant has an HLB of 7 to 18.

6. The method claimed in claim 5 wherein said nonionic surfactant has an HLB of 11 to 13.

7. The method claimed in claim 1 wherein said nonionic surfactant is an alkoxylated linear alcohol.

8. The method claimed in claim 1 wherein said anionic surfactant is selected from the group consisting of carboxylic acid capped ethoxylated alkyl alcohols and alcohol ethoxycarboxylates.

9. The method claimed in claim 2 wherein said cationic polymer retains 10%–80% of its positive charge.

10. The method claimed in claim 1 further comprising a base in an amount effective to establish a pH of 3 to 10.

* * * * *